US006905575B2

(12) United States Patent
Linnonmaa et al.

(10) Patent No.: US 6,905,575 B2
(45) Date of Patent: Jun. 14, 2005

(54) ARRANGEMENT FOR THE WEB THREADING OF A MULTI-ROLL CALENDER

(75) Inventors: Pekka Linnonmaa, Järvenpää (FI); Antti Heikkinen, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/363,601

(22) PCT Filed: Jun. 20, 2001

(86) PCT No.: PCT/FI01/00585

§ 371 (c)(1),
(2), (4) Date: Jun. 13, 2003

(87) PCT Pub. No.: WO02/22951

PCT Pub. Date: Mar. 21, 2002

(65) Prior Publication Data

US 2004/0020620 A1 Feb. 5, 2004

(30) Foreign Application Priority Data

Sep. 6, 2000 (FI) ..... 20001965

(51) Int. Cl.[7] ..... D21G 1/00

(52) U.S. Cl. ..... 162/361; 162/360.3; 162/193; 100/162 R; 100/173

(58) Field of Search ..... 162/193, 194, 162/205, 206, 199, 289, 272, 286, 361, 360.3; 226/7, 91, 92; 100/162 R, 163 A, 166, 173, 328–331, 35–38, 47

(56) References Cited

U.S. PATENT DOCUMENTS

| | | | | | |
|---|---|---|---|---|---|
| 1,428,852 | A | * | 9/1922 | McCarthy | 100/173 |
| 2,755,711 | A | * | 7/1956 | Moore | 100/166 |
| 2,776,605 | A | * | 1/1957 | McAfoos | 100/173 |
| 3,756,912 | A | | 9/1973 | Rooney | |
| 4,491,503 | A | * | 1/1985 | Adams et al. | 162/232 |
| 4,552,620 | A | | 11/1985 | Adams | |
| 4,918,836 | A | | 4/1990 | Wedel | |
| 5,784,955 | A | * | 7/1998 | Conrad | 100/329 |

FOREIGN PATENT DOCUMENTS

WO WO 02/22951 3/2002

* cited by examiner

*Primary Examiner*—Eric Hug
(74) *Attorney, Agent, or Firm*—Stiennon & Stiennon

(57) ABSTRACT

In a paper/board or finishing/converting machine, a calender (1) comprises a number of rolls (2, 3) formed into a roll stack, and a number of lift-out rolls (4), which are arranged in such a way that the web (W) being treated travels from one calender (1) nip (N) to another via a lift-out roll (4). Between the calender (1) roll (2, 3) and the lift-out roll (4), the web (W) being treated is supported by means of at least one closing member (5, 5', 6) not extending through the nip (N), which closing member is formed by a belt, wire or metal wire (7), which is arranged to travel via two or more guide rolls (4, 8).

16 Claims, 1 Drawing Sheet

ARRANGEMENT FOR THE WEB THREADING OF A MULTI-ROLL CALENDER

CROSS REFERENCES TO RELATED APPLICATIONS

This application is a U.S. national stage application of International Application No. PCT/FI01/00585, filed Jun. 20, 2001, and claims priority on Finnish Application No. 20001965 filed Sep. 6, 2000, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an arrangement for the web threading of a multi-roll calender of a paper/board or finishing/converting machine, which calender comprises a number of rolls formed into a roll stack, and a number of lift-out rolls, which are arranged in such a way that the web being treated travels from one calender nip to another via a lift-out roll.

With paper machines, the trend has for long been to close open transfers in order to improve runnability. As a result of online calendering, the first open transfers are between the dryer section of the paper machine and the calender, and in the set of rolls of the calender.

Nowadays it is known that many web breaks take place precisely at the calender. These can be eliminated quite efficiently by closing the web threadings inside the calender and between the dryer section and the calender. Closing the web threading before and after the calender is not in any way extraordinary. The problem is instead how to accomplish functional closing of the web threading in the set of calender rolls.

The web threadings of the calender will in future have to be closed due to, among other things, higher running speeds, whereby the loads on the web will increase due to the optimisation of draws, or in general to improve time efficiency.

One solution for closing the web threading of a calender is disclosed in the publication U.S. Pat. No. 4,552,620. In it, the belt used for closing the web threading is looped through the calender nips (see appended FIG. 1). The paper web travels through each nip between the belt and the roll. The web is not supported in a completely satisfactory manner when it travels through the calender. The situation can be somewhat improved by applying the known solution to a calender of the above-mentioned type which is equipped with lift-out rolls.

SUMMARY OF THE INVENTION

The object of the invention is to provide a reliable arrangement for closing the web threading of a multi-roll calender.

The solution relating to the invention is characterised in that between the calender roll and the lift-out roll, the web being treated is supported by means of at least one closing member not extending through the nip, which closing member is formed by a belt, wire or metal wire, which is arranged to travel via two or more guide rolls.

In one embodiment of the invention this has been implemented in such a way that a first closing member picks the web up from the surface of the calender roll, and a second closing member transfers the web onto the surface of the next calender roll.

In another embodiment of the invention this has been implemented in such a way that the closing member picks the web up from the surface of a calender roll and returns the web onto the surface of the same calender roll, from where the web is conveyed to the next nip along the surface of the calender roll. In such a case, the most preferable arrangement is such that the closing member comprises at least three guide rolls located at the vertexes of a polygon, and in addition at least one guide roll formed into a lift-out roll and arranged inside the area limited by the vertexes of the said polygon.

The invention is described in greater detail in the following, with reference to the accompanying drawings.

DESCRIPTION OF THE PREFERRED EMBODIMENTS

Figure 3:
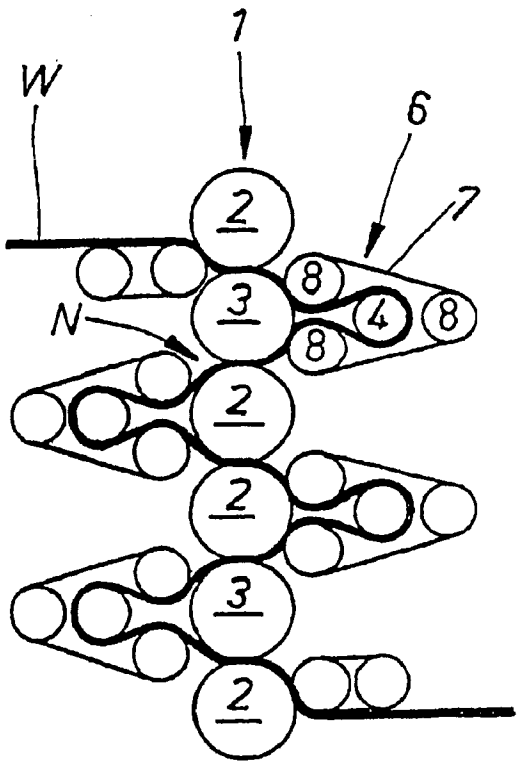
FIG. 3 shows diagrammatically a multi-roll calender in which is used closed web threading according to a second embodiment of the invention.
Figure 2:
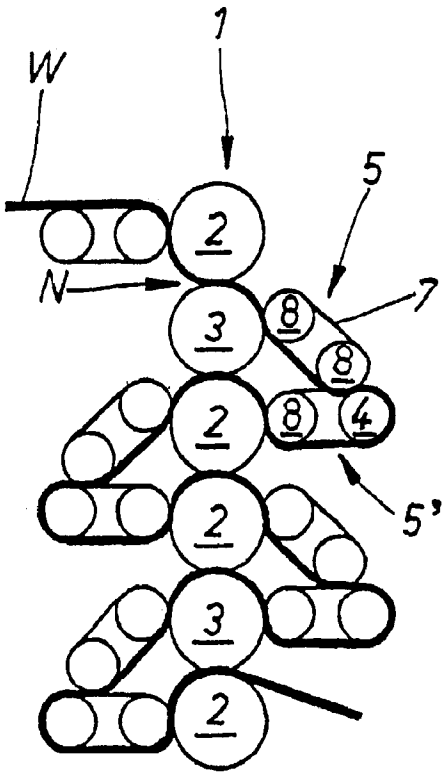
FIG. 2 shows diagrammatically a multi-roll calender in which is used closed web threading according to a first embodiment of the invention.

FIGS. 2 and 3 show an arrangement according to the invention for closing the web threading of the multi-roll calender 1 of a paper/board or finishing/converting machine. The calender 1 comprises a number of rolls 2, 3 formed into a roll stack, and a number of lift-out rolls 4, which are arranged in such a way that the web W being treated travels from one calender 1 nip N to another via a lift-out roll 4.

Figure 1:
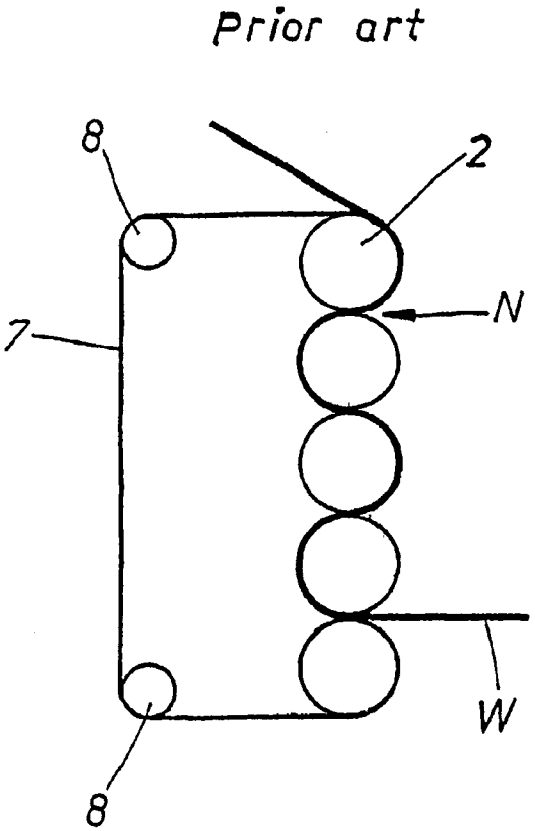
FIG. 1 shows diagrammatically a calender in which is used closed web threading according to the prior art.

FIG. 1 shows a prior art solution which was already referred to in the introduction to the specification.

In the solution according to FIGS. 2 and 3, the calender 1 comprises alternately a hard metal roll 3 and a soft fibre or polymer roll 2. The drive may take place, for example, by means of one roll, whereby power transmission to the other rolls takes place by means of frictional forces, or each roll has its own drive. Since the properties of paper develop better on the hard roll side of the nip, a so-called turning nip, which has two soft rolls 2 positioned in succession, is used near the centre of the calender. In this way, also the other side of the paper is treated against the hard rolls 3 at the end part of the calender.

Between the calender 1 roll 2, 3 and the lift-out roll 4, the web W being treated is supported by means of at least one closing member 5, 5' (FIG. 2), 6 (FIG. 3) not extending through the nip N. The closing member is formed by a belt, wire or metal wire 7, which is arranged to travel via two or more guide rolls 4, 8. The closing member 5, 5', 6 forms its own endless cycle.

In the embodiment according to FIG. 2, the first closing member 5 picks the web W up from the surface of the calender 1 roll 2 or 3, and the second closing member 5' transfers the web onto the surface of the next calender roll. The grip on the web W is turned between the first and second closing members 5, 5'. The guide roll of the closing member 5' marked by reference numeral 4 forms a lift-out roll. The closing member 5, 5' does not pass through the nip N, but the web W is picked up from either a polymer roll 2 or a metal roll 3 onto an underpressurized, full-width wire or corresponding closing member 7. Supported by the wire, the web W undergoes the turn of the grip and is transferred onto the surface of the next roll by means of another underpressurized transfer system. The transfer of the web W is ensured by means of an adhesion difference or an overpressure zone. On the other hand, web tension will effect this transfer automatically. The web W is conveyed to the next nip N along the surface of the roll. Between the first and second suction transfer systems can be used underpressures of different magnitudes, which ensures the changeover of the grip from one system to the other.

The drives of the calender rolls operate the closing member, or the members have their own drives. If power is transmitted from the roll to the wire closing system, this contact may have a positive effect in that it heats the web.

The amount of evaporation of the calender can be limited by means of the closing member and air conditioning.

The closing member makes threading possible without having any separate devices in the stack. Gradually progressing threading also becomes possible. In addition, threading may be of full width.

In the solution relating to FIG. 3, the closing member 6 picks the web W up from the surface of the calender 1 roll 2 or 3, and returns the web W onto the surface of the same roll, from where the web is conveyed to the next nip N along the surface of the calender roll.

In this solution, the closing member 6 comprises at least three guide rolls 8 located at the vertexes of a polygon, and in addition at least one guide roll 4 formed into a lift-out roll and arranged inside the area limited by the vertexes of the said polygon.

In the solutions relating to FIGS. 2 and 3, the web W is conveyed to the nip N along the surface of the calender 1 roll 2, 3. At least one guide roll 8 of the closing member 5, 5', 6 presses the closing means 7 of the closing member against the calender 1 roll 2, 3.

The closing member 5, 5', 6 is arranged to be underpressurized to ensure the transfer.

What is claimed is:

1. An arrangement for the web threading of a multi-roll calender of a paper/board or finishing/converting machine, which calender comprises a plurality of rolls formed into a roll stack to define a plurality of calender nips, and a plurality of lift-out rolls, which are arranged in such a way that the web being treated travels from one calender nip to another via a lift-out roll, wherein a first nip is defined between a first calender roll and a second calender roll, and a first lift-out roll is positioned spaced from the both the first calender roll and the second calender roll, wherein as the web travels between the first calender roll and the first lift-out roll, the web being treated is supported by at least one closing member not extending through the nip, which closing member is formed by a belt, wire or metal wire, which is arranged to travel via at least two guide rolls.

2. The arrangement of claim 1 wherein the closing member picks the web up from the surface of a calender roll and returns the web onto the surface of the same roll, from where the web is conveyed to the next nip along the surface of the calender roll.

3. The arrangement of claim 2 wherein the closing member comprises at least three guide rolls located at the vertexes of a polygon, and in addition at least one guide roll formed into a lift-out roll and arranged inside the area limited by the vertexes of the said polygon.

4. The arrangement of claim 1 wherein the web is conveyed to the nip along the surface of the calender roll.

5. The arrangement of claim 1 wherein at least one guide roll of the closing member presses said belt, wire or metal wire of the closing member against the calender roll.

6. The arrangement of claim 1 wherein the closing member is arranged to be underpressurized.

7. An arrangement for the web threading of a multi-roll calender of a paper/board or finishing/converting machine, which calender comprises a plurality of rolls formed into a roll stack to define a plurality of calender nips, and a plurality of lift-out rolls, which are arranged in such a way that the web being treated travels from one calender nip to another via a lift-out roll, wherein between the calender roll and the lift-out roll, the web being treated is supported by at least one closing member not extending through the nip, which closing member is formed by a belt, wire or metal wire, which is arranged to travel via at least two guide rolls, wherein a nip is defined between a first calender roll and a second calender roll, and wherein a first closing member picks the web up from the surface of the first calender roll, and a second closing member transfers the web onto the surface of the second calender roll.

8. The arrangement of claim 7 wherein the first closing member picks the web up by engaging a first side of the web, and the second closing member engages a second, opposite, side of the web.

9. The arrangement of claim 7 wherein at least one guide roll of the first closing member is a lift-out roll.

10. A calender in a paper machine, for the treatment of a web traveling therethrough, the calender comprising:

a plurality of calender rolls in a roll stack defining a plurality of nips, the roll stack having a first calender roll which defines a first nip with a subsequent second calender roll, and a third calender roll which defines a second nip with the second calender roll;

a plurality of lift-out rolls, wherein a first lift-out roll is spaced from the second calender roll and the third calender roll and positioned such that the web travels over the first lift-out roll as it extends between the first nip and the second nip; and a first closing member extending between the second calender roll and the first lift-out roll, the closing member supporting the web as it travels from the first nip to the second nip, the closing member not extending through the first nip or the second nip, the closing member being a belt, wire, or metal wire which travels over the first lift-out roll and at least one additional guide roll.

11. The calender of claim 10 wherein the first closing member picks the web up from the surface of the second calender roll and returns the web onto the surface of the same calender roll, from where the web is conveyed to the second nip along the surface of tho second calender roll.

12. The calender of claim 11 wherein the closing member travels over at least three guide rolls located at the vertexes of a polygon, wherein the first lift-out roll is arranged inside the area limited by the vertexes of the said polygon.

13. A calender in a paper machine, for the treatment of a web traveling therethrough, the calender comprising:

a plurality of calender rolls in a roll stack defining a plurality of nips, the roll stack having a first calender roll which defines a first nip with a subsequent second calender roll, and a third calender roll which defines a second nip with the second calender roll;

a plurality of lift-out rolls, wherein a first lift-out roll is positioned such that the web travels over the first lift-out roll as it extends between the first nip and the second nip; and a first closing member extending between the second calender roll and the first lift-out roll, the closing member supporting the web as it travels from the first nip to the second nip, the closing member not extending through the first nip or the second nip, the closing member being a belt, wire, or metal wire which travels over the first lift-out roll and at least one additional guide roll, wherein the first closing member picks the web up from the surface of the second calender roll, and a second closing member transfers the web from the first closing member onto the surface of the third calender roll.

14. A calender in a paper machine, for the treatment of a web traveling therethrough, the calender comprising:

a plurality of calender rolls in a roll stack defining a plurality of nips, the roll stack having a first calender roll which defines a first nip with a subsequent second calender roll, and a third calender roll which defines a second nip with the second calender roll;

a plurality of lift-out rolls spaced from the calender rolls, wherein a first lift-out roll is positioned such that the web travels over the first lift-out roll as it extends between the first nip and the second nip;

at least one first belt which extends about the first lift-out roll and travels in an endless cycle, the first belt supporting the web as it travels from the first nip to the first lift-out roll, the first belt not extending through the first nip or the second nip; and a first guide roll located within the endless cycle of the first belt which presses the first belt against the second calender roll, the web travelling from the first nip to the second nip.

15. The calender of claim 14 further comprising:

a second guide roll located within the endless cycle of the first belt which presses the first belt against the second calender roll downstream of the first guide roll; and a third guide roll located within the endless cycle of the first belt, the web not traveling over the third guide roll.

16. A calender in a paper machine, for the treatment of a web traveling therethrough, the calender comprising:

a plurality of calender rolls in a roll stack defining a plurality of nips, the roll stack having a first calender roll which defines a first nip with a subsequent second calender roll, and a third calender roll which defines a second nip with the second calender roll;

a plurality of lift-out rolls, wherein a first lift-out roll is positioned such that the web travels over the first lift-out roll as it extends between the first nip and the second nip;

at least one first belt which extends about the first lift-out roll and travels in an endless cycle, the first belt supporting the web as it travels from the first nip to the first lift-out roll, the first belt not extending through the first nip or the second nip; and a first guide roll located within the endless cycle of the first belt which presses the first belt against the second calender roll, the web travelling from the first nip to the second nip;

a second belt traveling in an endless cycle and extending around a second lift-out roll; and a second guide roll located within the endless cycle of the second belt which presses the second belt against the third calender roll, the web traveling from the first belt to the second belt as it travels from the first nip to the second nip.

* * * * *